US011554511B2

(12) United States Patent
Seferi

(10) Patent No.: US 11,554,511 B2
(45) **Date of Patent: *Jan. 17, 2023**

(54) SAFETY KNIFE WITH SLIDABLE GRIP

(71) Applicant: Acme United Corporation, Fairfield, CT (US)

(72) Inventor: Nicholas L. Seferi, Southbury, CT (US)

(73) Assignee: Acme United Corporation, Fairfield, CT (US)

( * ) Notice: Subject to any disclaimer, the term of this patent is extended or adjusted under 35 U.S.C. 154(b) by 153 days.

This patent is subject to a terminal disclaimer.

(21) Appl. No.: 17/076,075

(22) Filed: Oct. 21, 2020

(65) Prior Publication Data

US 2021/0053243 A1 Feb. 25, 2021

Related U.S. Application Data

(63) Continuation-in-part of application No. 16/999,653, filed on Aug. 21, 2020.

(60) Provisional application No. 62/890,651, filed on Aug. 23, 2019.

(51) Int. Cl.

| | |
|---|---|
| ***B26B 29/02*** | (2006.01) |
| ***B26B 5/00*** | (2006.01) |
| ***B25G 1/10*** | (2006.01) |

(52) U.S. Cl.

CPC ..... *B26B 29/02* (2013.01); *B25G 1/102* (2013.01); *B26B 5/003* (2013.01); *B26B 5/005* (2013.01)

(58) Field of Classification Search

None

See application file for complete search history.

(56) References Cited

U.S. PATENT DOCUMENTS

| | | | | |
|---|---|---|---|---|
| 4,086,698 | A * | 5/1978 | Sparks | B26B 29/02 30/2 |
| 4,091,537 | A * | 5/1978 | Stevenson, Jr. | B26B 29/02 30/294 |
| 5,093,994 | A * | 3/1992 | Karas | B26B 5/001 30/162 |
| 5,890,290 | A * | 4/1999 | Davis | B26B 29/02 30/162 |
| 5,906,049 | A * | 5/1999 | Butts | B26B 5/001 30/125 |
| 6,233,832 | B1 * | 5/2001 | Berns | B26B 5/00 30/162 |
| 6,543,140 | B1 * | 4/2003 | Davis | B26B 5/001 30/162 |
| 6,892,456 | B2 * | 5/2005 | Yu Chen | B26B 27/005 30/2 |
| 8,375,588 | B2 * | 2/2013 | Gringer | B26B 5/001 30/162 |
| 10,994,430 | B2 * | 5/2021 | Wang | B26B 29/02 |
| 2009/0151168 | A1 * | 6/2009 | Dadam | B26B 5/001 30/162 |

(Continued)

FOREIGN PATENT DOCUMENTS

GB 2 192 358 A * 1/1988

*Primary Examiner* — Hwei-Siu C Payer

(74) *Attorney, Agent, or Firm* — Alix, Yale & Ristas, LLP

(57) ABSTRACT

A safety knife functions as both a box cutter and a separate line cutter. A slidable grip is manually displaceable between two stable safety positions. In one safety position, the grip obstructs access to a forwardly projecting blade. In a second safety position, the grip obstructs access to the line cutter.

20 Claims, 19 Drawing Sheets

(56) References Cited

U.S. PATENT DOCUMENTS

| | | | | |
|---|---|---|---|---|
| 2011/0167646 | A1* | 7/2011 | Schmidt | B26B 5/001 30/151 |
| 2013/0192069 | A1* | 8/2013 | Reibold | B26B 1/10 30/295 |
| 2013/0199047 | A1* | 8/2013 | Herlitz | B26B 29/02 30/162 |
| 2014/0259686 | A1* | 9/2014 | Garavaglia | B26B 5/003 30/156 |
| 2015/0174772 | A1* | 6/2015 | Kanemoto | B26B 5/001 30/152 |
| 2016/0023364 | A1* | 1/2016 | Raymond | B26B 29/00 30/162 |
| 2021/0053242 | A1* | 2/2021 | Seferi | B25G 1/102 |
| 2021/0053243 | A1* | 2/2021 | Seferi | B26B 5/003 |

* cited by examiner

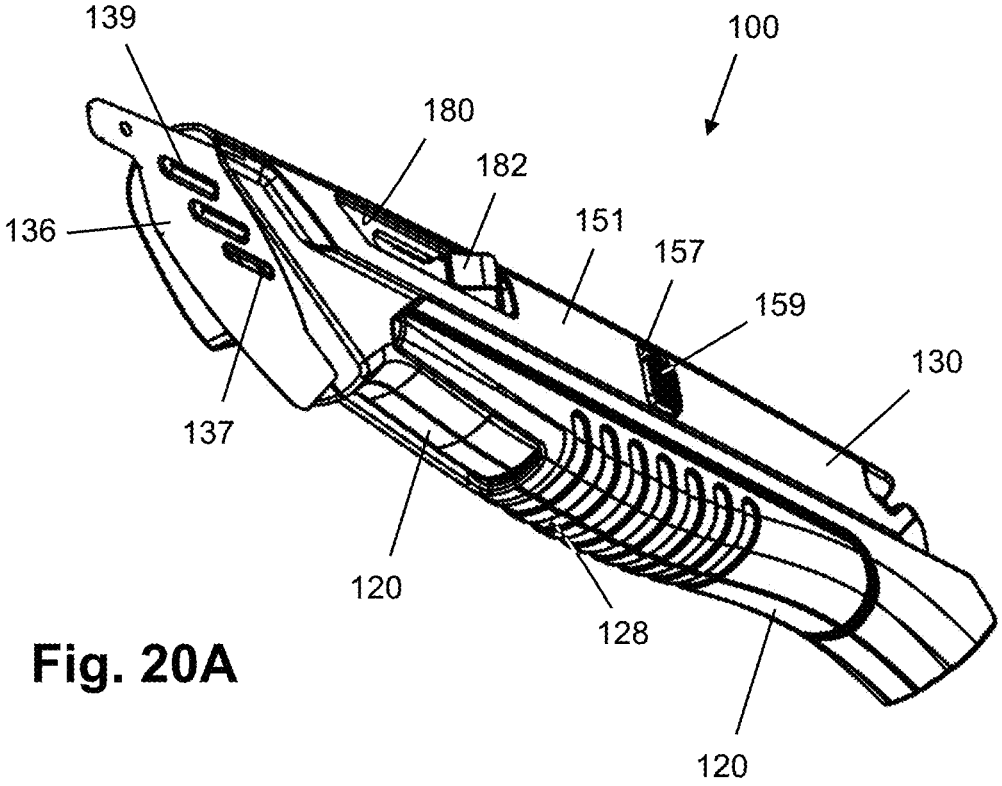
Fig. 20A
Fig. 20B
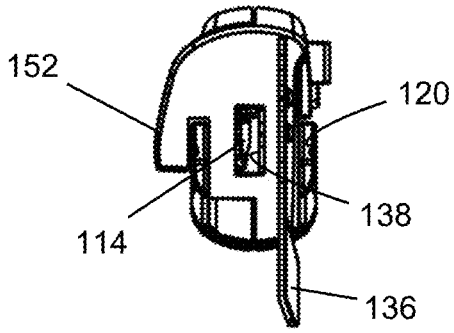
Fig. 20C
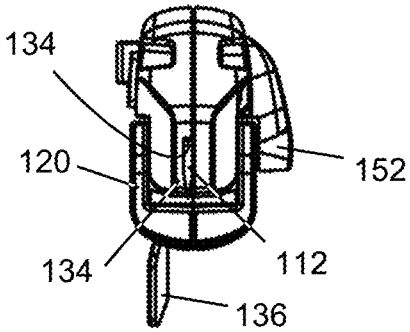

SAFETY KNIFE WITH SLIDABLE GRIP

CROSS-REFERENCE TO RELATED APPLICATION

This application is a continuation-in-part of U.S. patent application Ser. No. 16/999,653 filed on Aug. 21, 2020, which application claims the priority of U.S. Provisional Application No. 62/890,651 filed on Aug. 23, 2019, the disclosure of which is incorporated by reference in its entirety.

BACKGROUND

This disclosure relates generally to utility knives which are commonly referred to as box cutters. More particularly, this disclosure relates to utility knives which have a dual cutting blade configuration.

For utility knives to which the present disclosure relates, an elongated housing employs a slide assembly which is manually displaceable for projecting a cutting blade through a frontal opening. The cutting blades are typically trapezoidal or quasi-trapezoidal in shape. The housing is formed by a pair of elongated sections which are relatively displaceable to allow for blade replacement or removal. In some conventional utility knives, multiple replacement blades are stored within the housing and are mountable for use to replace a degraded cutting blade.

SUMMARY

Briefly stated, a safety utility knife has a housing with a front having a frontal blade opening. The housing also has a rear opening protectively leading to a restricted blade opening. A grip is mounted to the housing for slidable displacement between a first position obstructing access to a blade projecting from the frontal blade opening and a second position obstructing access to a blade positioned at the restricted blade opening. A first mechanism selectively secures the grip in a stable engagement at either the first position or the second position. A second mechanism slidably projects a blade for extension through the frontal opening at multiple exposed positions.

The housing has a longitudinal slot. The grip is secured to a slide member disposed in the housing through the slot. The slide member has a pair of longitudinally spaced detents. A spring-loaded pin is receivable in one of the detents. The housing mounts a displaceable button which is manually moveable to withdraw the pin from a detent and allow the slide member to slide relative to the housing.

A blade is fixedly mounted for access through the restricted blade opening. Another blade is mounted to a longitudinally positionable slide. The housing mounts a longitudinally displaceable actuator which is manually moveable to change the position of the slide.

The grip preferably has a plurality of longitudinally spaced, transversely extending serrations. The grip preferably has a rubber molded composition. The grip has a quasi-U-shaped section which extends at opposed sides of the housing. The front of the knife has a nose-like configuration.

In another embodiment, a knife comprises a housing having a frontal blade opening and a rear restricted blade opening. A protective grip is mounted to the housing and is slidably displaceable along the housing between a first position obstructing access to a blade projecting from the frontal blade opening and a second position obstructing access to a blade disposed in the restricted blade opening. A stabilizer assembly selectively secures the protective grip in a stable engagement at the first position or the second position.

The housing has a longitudinal slot. The grip is secured through the slot to a slide member disposed in the housing. The slide member has a pair of longitudinally spaced detents. A spring-loaded lug is receivable in a detent. The housing has an exterior opening with a displaceable button manually moveable to withdraw the lug from a detent and allow the slide member to slide relative to the housing.

The housing has a longitudinal slot and a projecting actuator is mounted in fixed relationship to a blade positioner assembly and is accessible through the slot to facilitate longitudinal displacement of a blade relative to the restricted blade opening.

The slide member further comprises a pawl engageable in a first detent at the first position and engageable in a second detent at the second position.

A blade positioning assembly is manually slidably moveable to longitudinally displace a blade relative to the housing. The blade positioning assembly comprises a longitudinally displaceable actuator moveable to displace the blade. A metal shield at a rear portion of the housing at least partially forms an access slot leading to the restricted blade opening.

BRIEF DESCRIPTION OF THE DRAWINGS

FIGS. 20A, 20B and 20C are respectively a front perspective view, a left end view and a right end view of a second embodiment of a safety knife with a grip disposed in a first position;

DETAILED DESCRIPTION

Figure 1:
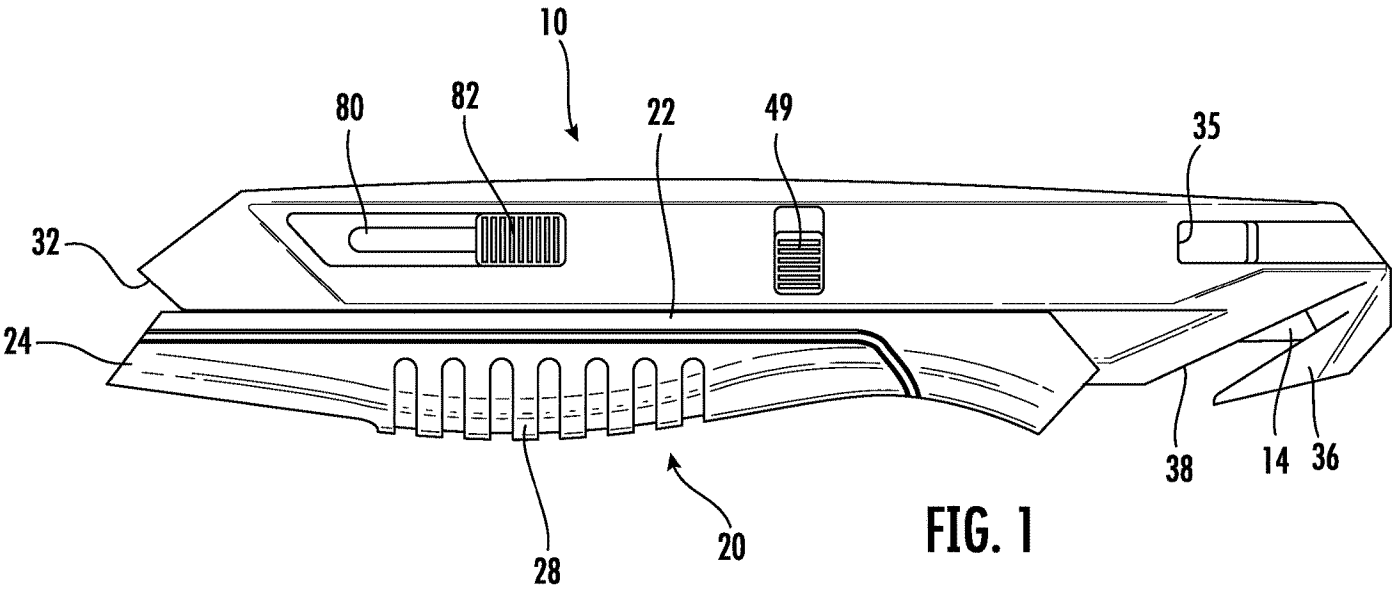
FIG. 1 is a front side view, partly diagrammatic, of a safety knife with a grip disposed in a first position.
Figure 2:
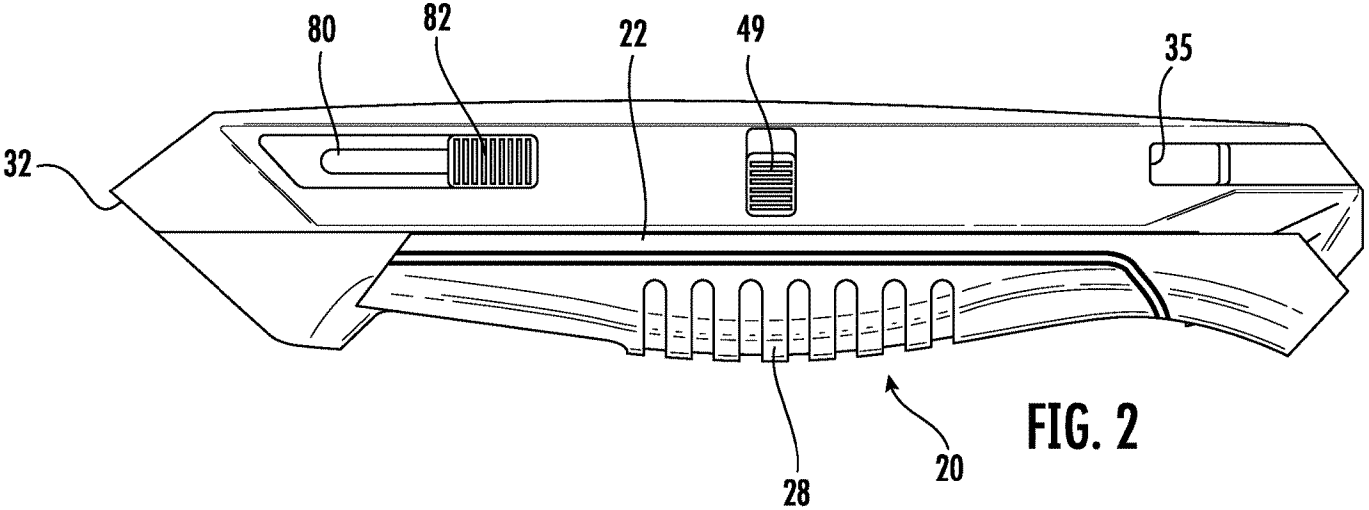
FIG. 2 is a front side view of the knife of FIG. 1 with the grip being disposed in a second position.
Figure 3:
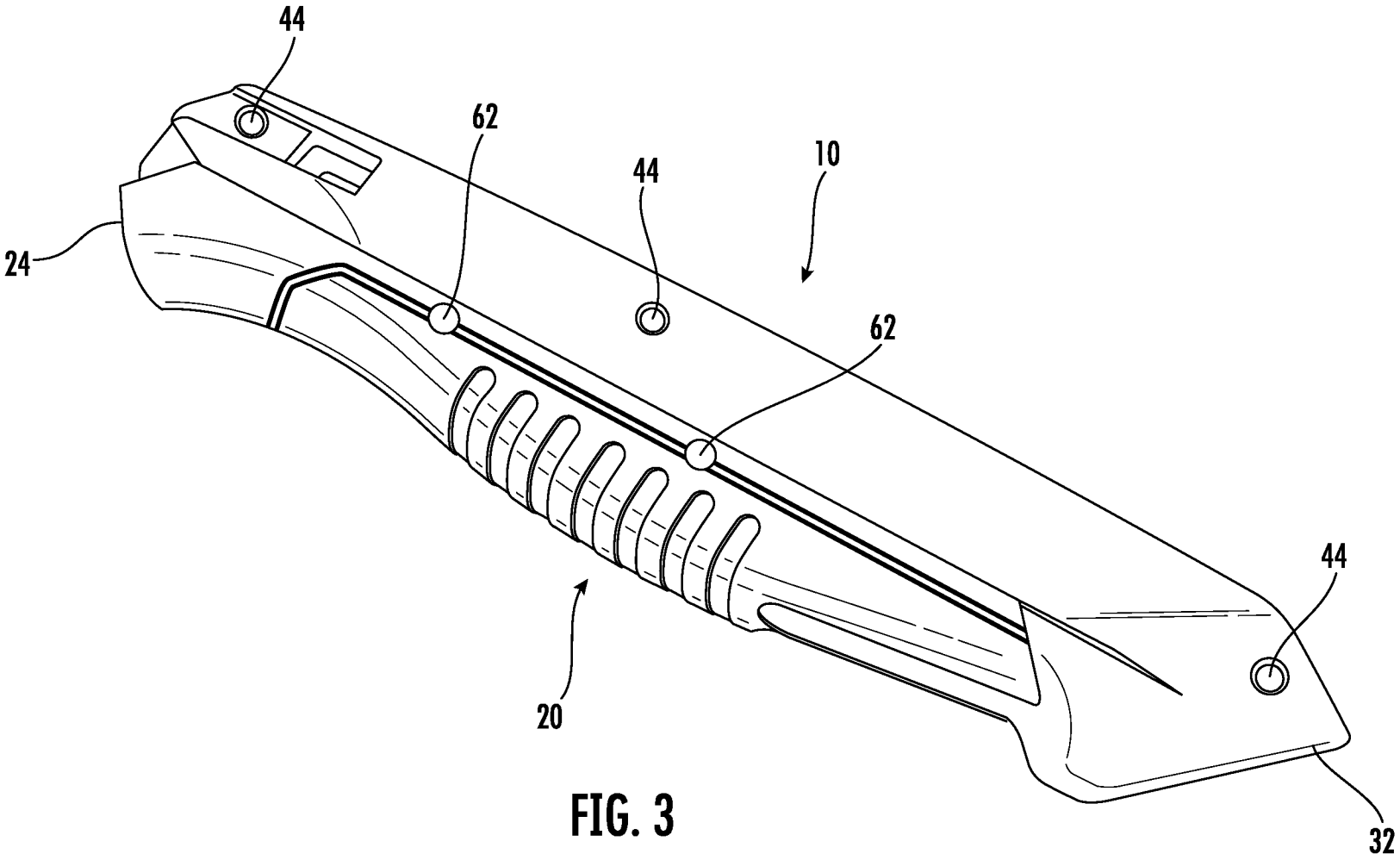
FIG. 3 is a generally back perspective view of the knife at the grip position of FIG. 2.

With reference to the drawings wherein like numerals represent like parts throughout the several figures, a safety utility knife in accordance with the present disclosure is generally designated by the numeral 10. The safety knife functions as both a box cutter and a separate line cutter. The safety knife incorporates a slidable protective grip 20 which is manually longitudinally displaceable and maintainable in two stable safety positions. In a first stable safety position illustrated in FIG. 1, the grip 20 is positioned at a forward position to obstruct access to a forward projecting blade 12. In a second stable safety position best illustrated in FIG. 2, the protective grip is disposed in a second rearward position restricting access to the line cutter blade 14.

The safety knife has an elongated contoured aesthetically pleasing housing 30. The protective grip 20 likewise has a coordinated contoured structure which has a soft and convenient feel for the user as will be detailed below.

The knife has a housing 30 which is formed from a pair of elongated shell-like sections 40 and 50. The sections engage along a medial centerline through the top and bottom. The forward portion of the housing forms a nose-like protuberance 32. The protuberance defines a frontal blade opening 34. A rear portion of the housing forms a sleek rear shield 36 to obstruct access to a restricted blade opening 38. In one preferred embodiment, the housing also has a rectangular through opening 35 which allows the knife to be tethered to a chain or hung on a hook or appendage as desired.

Figure 5:
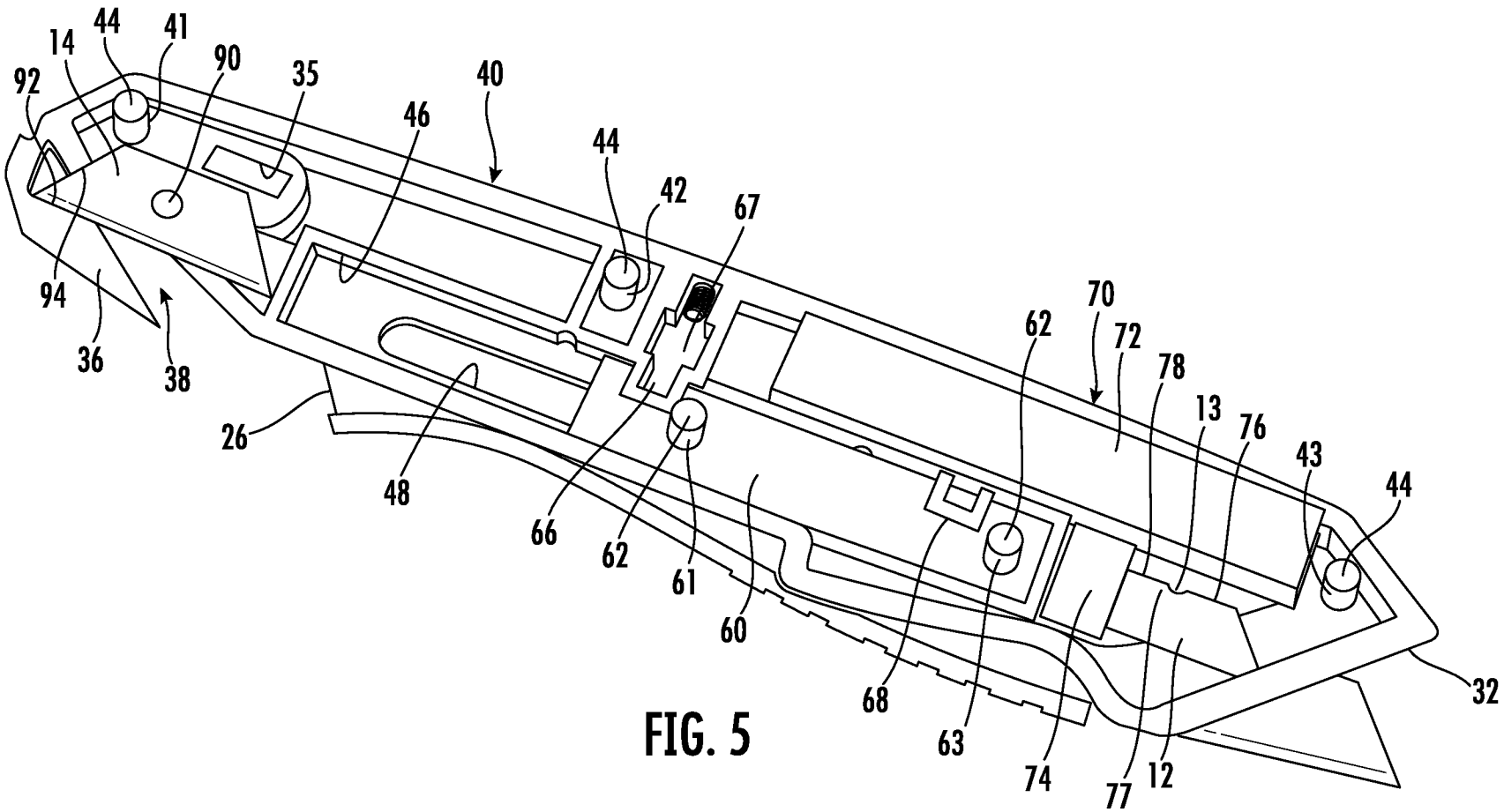
FIG. 5 is a perspective view with a portion of the blade being removed and further illustrating the grip of FIG. 1.
Figure 6:
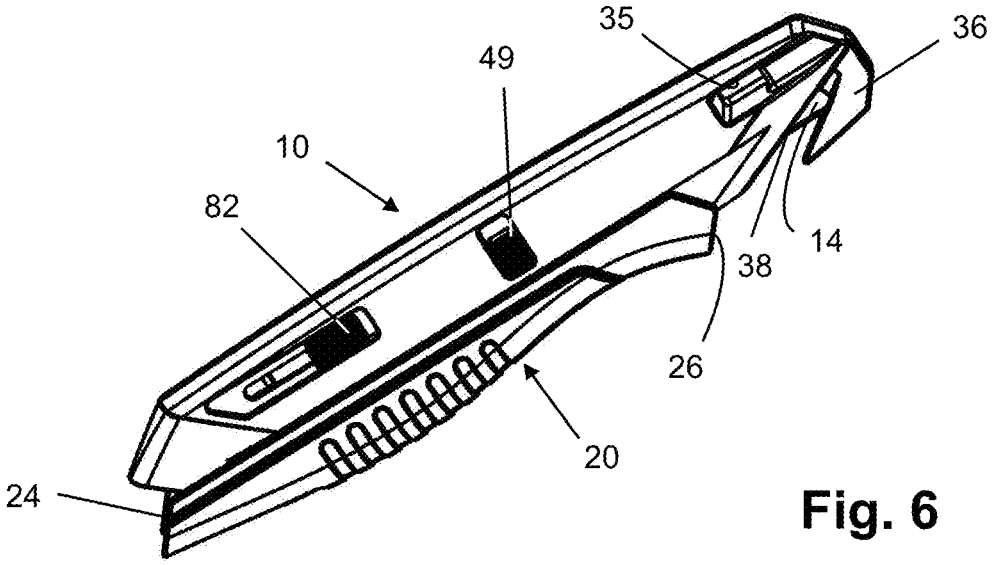
FIG. 6 is a generally frontal perspective view of the knife with the grip position of FIG. 1.
Figure 11:
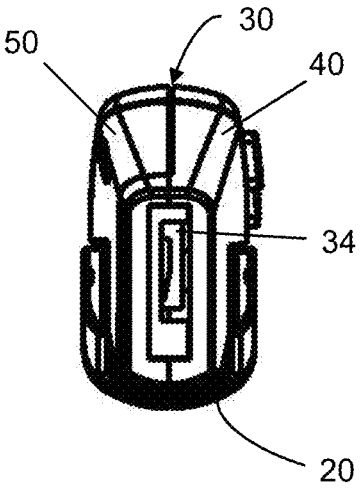
FIG. 11 is a left side view of the knife with the grip position of FIG. 1.
Figure 12:
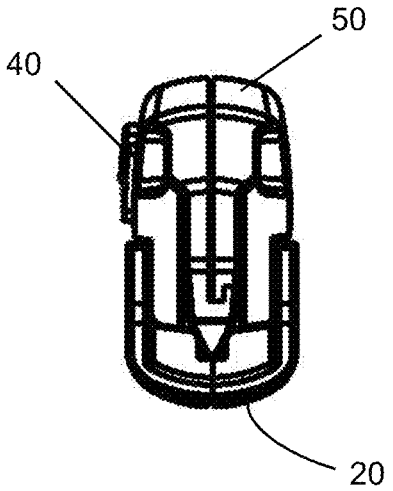
FIG. 12 is a right side view of the knife with the grip position of FIG. 1.
Figure 7:
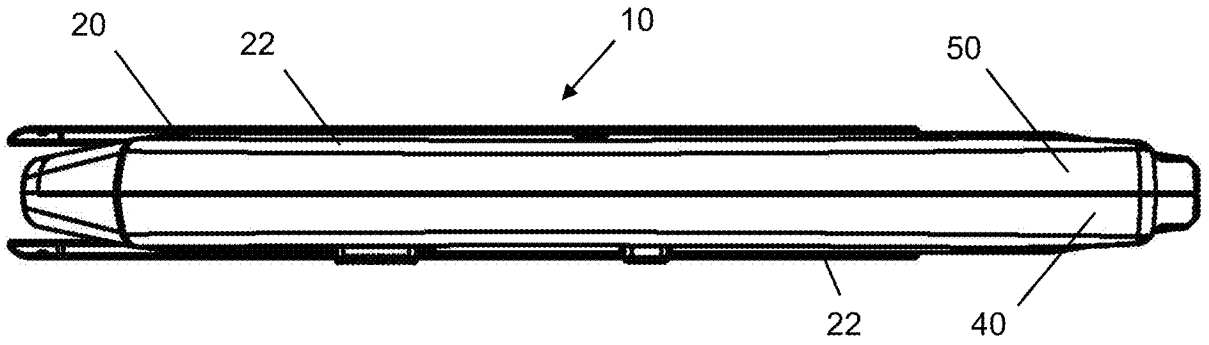
FIG. 7 is a top plan view of the knife with the grip position of FIG. 1.
Figure 8:
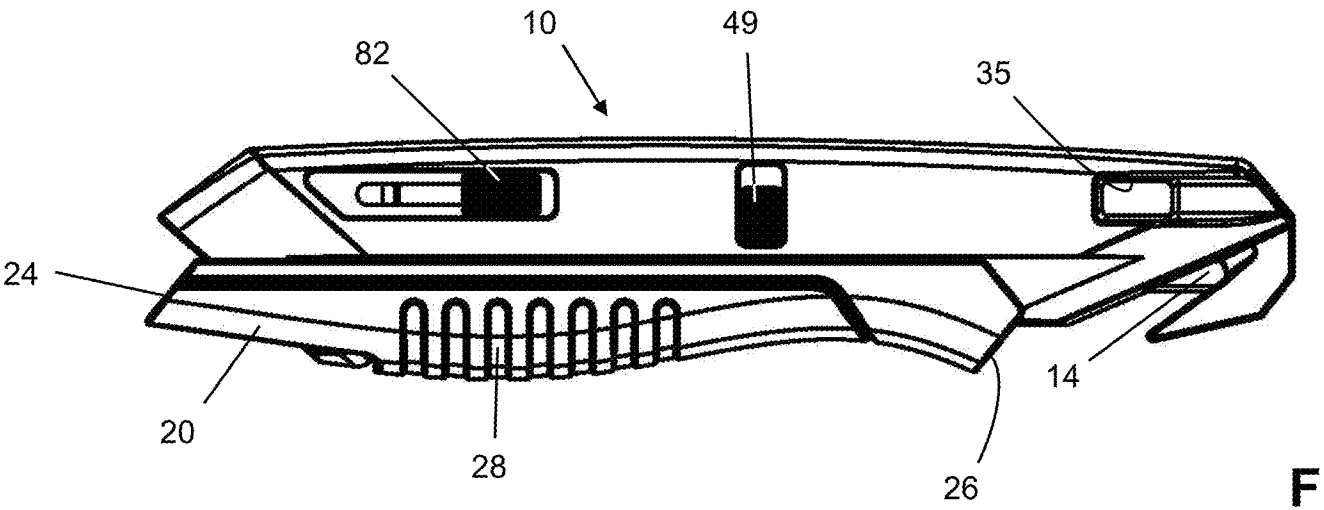
FIG. 8 is a front view of the knife with the grip position of FIG. 1.
Figure 9:
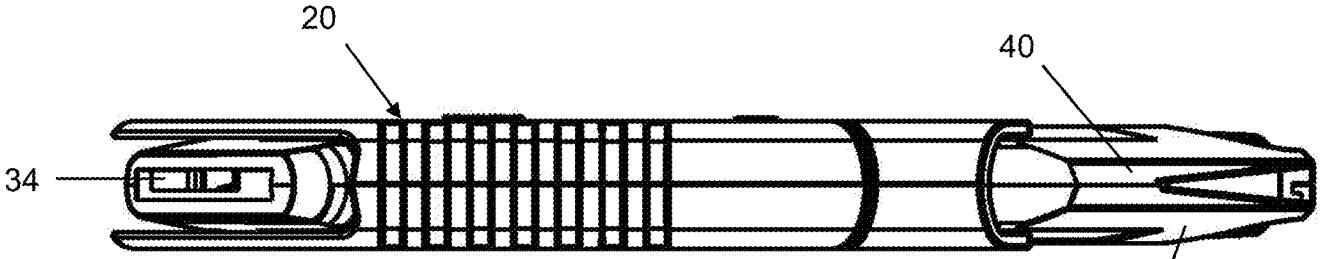
FIG. 9 is a bottom plan view of the knife with the grip position of FIG. 1.
Figure 10:
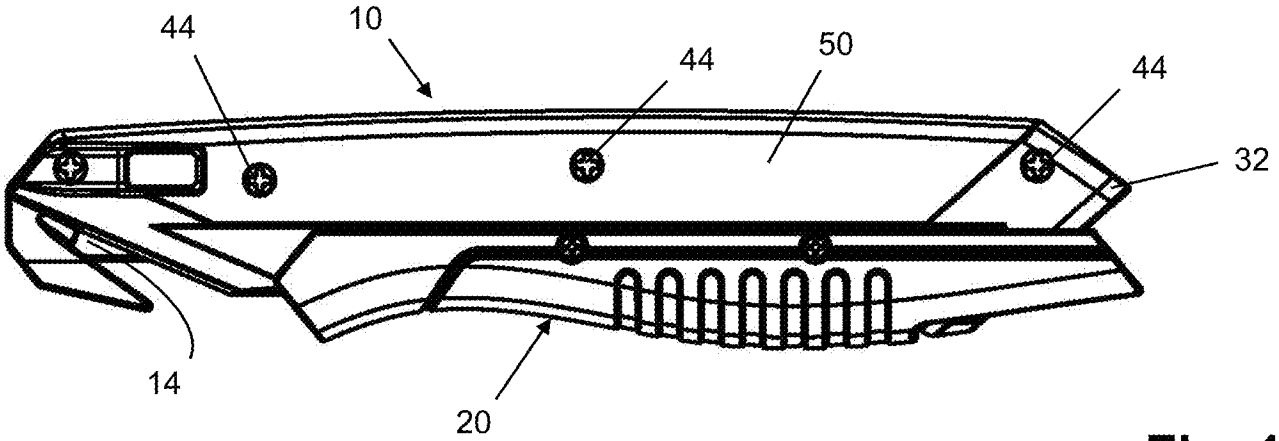
FIG. 10 is a back view of the knife with the grip position of FIG. 1.
Figure 13:
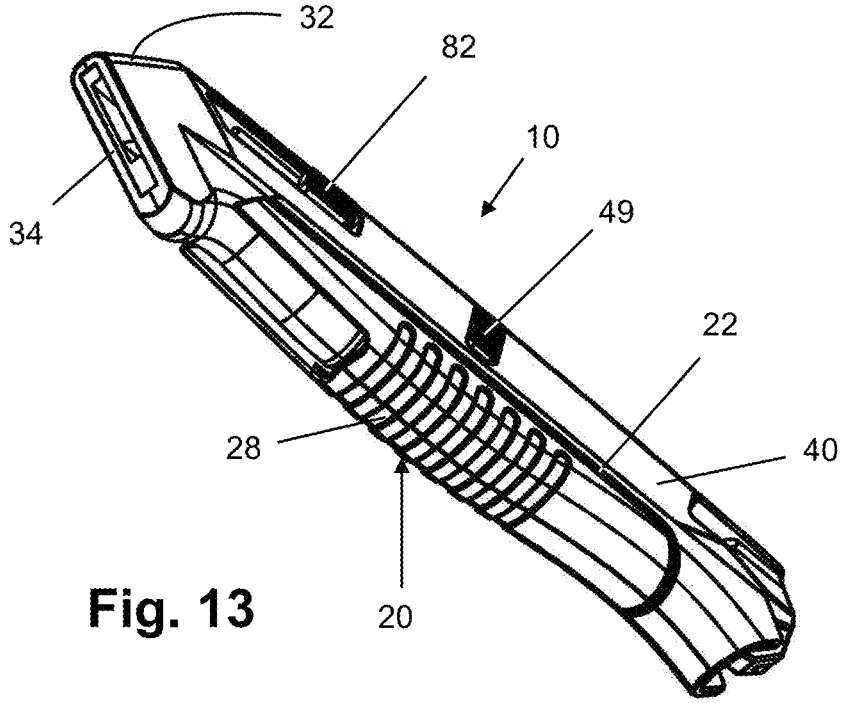
FIG. 13 is a perspective view of the knife with the grip position of FIG. 2.
Figure 18:
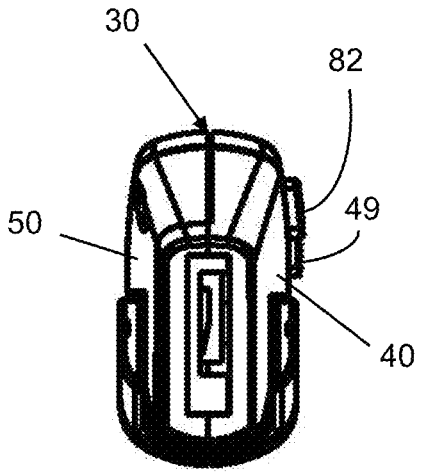
FIG. 18 is a left side view of the knife with the grip position of FIG. 2.
Figure 19:
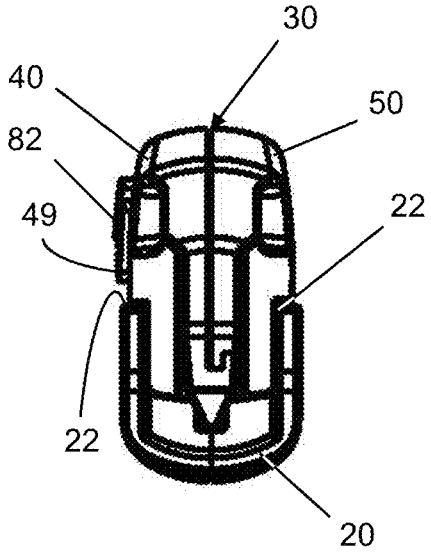
FIG. 19 is a right side view of the knife with the grip position of FIG. 2.
Figure 14:
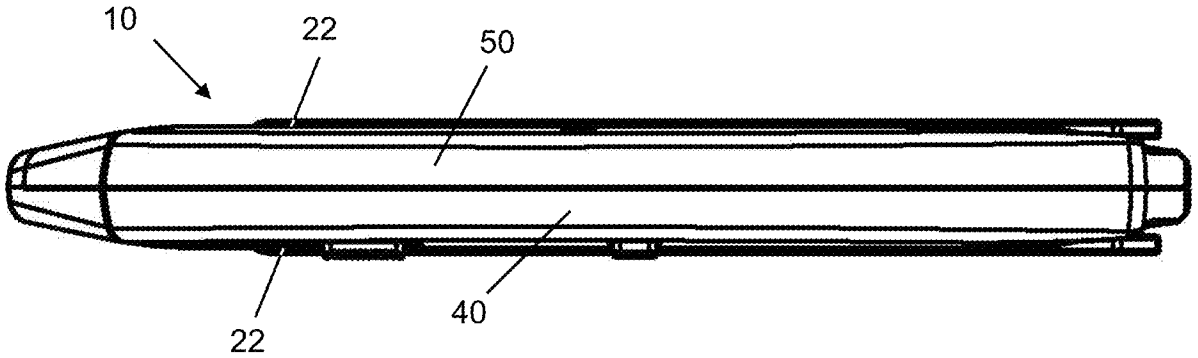
FIG. 14 is a top plan view of the knife with the grip position of FIG. 2.
Figure 15:
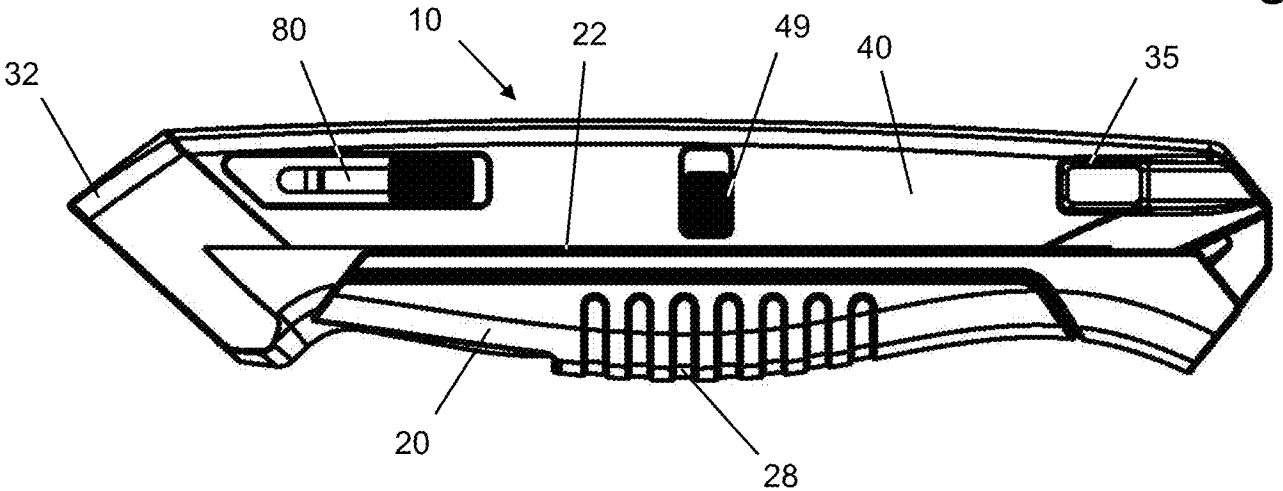
FIG. 15 is a front view of the knife with the grip position of FIG. 2.
Figure 16:
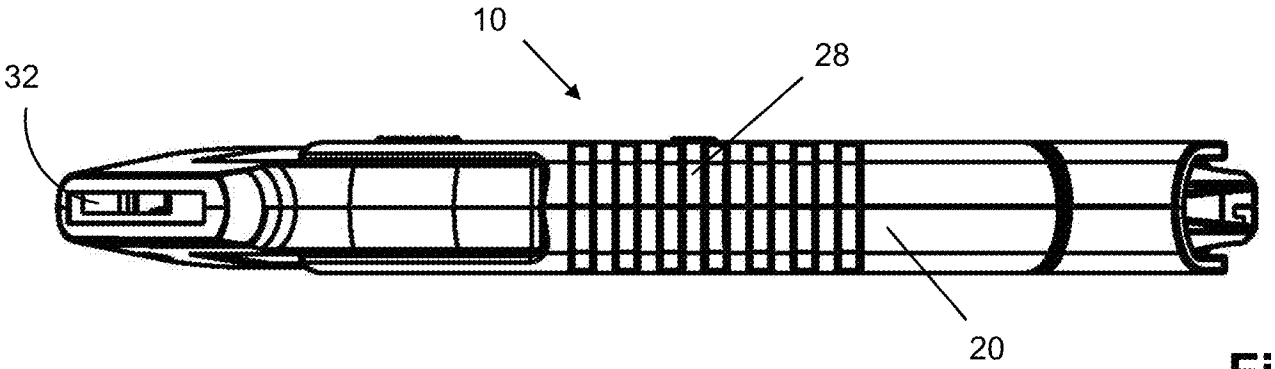
FIG. 16 is a bottom plan view of the knife with the grip position of FIG. 2.
Figure 17:
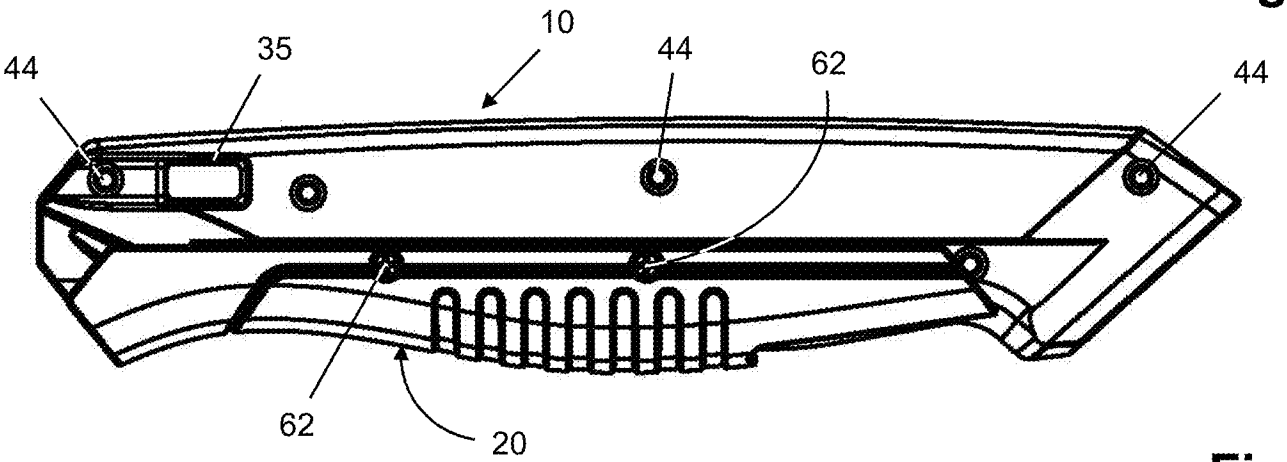
FIG. 17 is a back view of the knife with the grip position of FIG. 2.

With additional reference to FIG. 5, section 40 interiorly mounts three longitudinally spaced bosses 41, 42 and 43. The bosses receive screws 44 connecting through correspondingly located openings of the second section 50 to threadably engage the bosses to secure the sections together.

The housing section 40 interiorly receives and mounts a grip slider 60 which slides along a channel at the interior. The section also has a longitudinal slot 48. The slider mounts a pair of longitudinally spaced bosses 61 and 63. The bosses are receivable in a slot of section 50 and are alignable with corresponding openings in the grip. Screws 62 are threaded through the openings and slot into the bosses to secure the grip 20 to the slider 60.

The slider 60 also includes corresponding longitudinally spaced detents 66 and 68. The detents are alignable with a spring-loaded locking lug 67. Upon selective longitudinal displacement of the grip, a detent 66 or 68 will align with the locking lug 67. The lug is spring biased to engage in the detent to provide a stable fixed position of the slide, such as illustrated in FIG. 5. The opposed face of the section 40, which constitutes the frontal face of the knife, has a recess 47 which receives a button 49. When the button 49 is pushed upwardly, the locking lug 67 disengages from the detent and the grip is free to be longitudinally manually displaced relative to the sections 40 and 50. The two detents 66 and 68 essentially define the stable grip positions illustrated respectively in FIGS. 1 and 2.

The section 40 also interiorly mounts a blade slider assembly 70 having a blade slider 72 slidable in a channel formed at the interior of the section. A blade carrier 74 is fixedly mounted to and displaceable with the blade slider 72. The blade carrier 74 mounts the trapezoidal cutting blade 12 having an upper notch 13. The blade carrier 74 includes a forward plate 76 with a transverse projection 77 and a rear pocket 78. The projection 77 is complementary with the notch 13. The blade is partially received at a rear portion in the pocket 78, and the projection 77 locks into the notch to provide a stable blade mount.

Figure 4A:
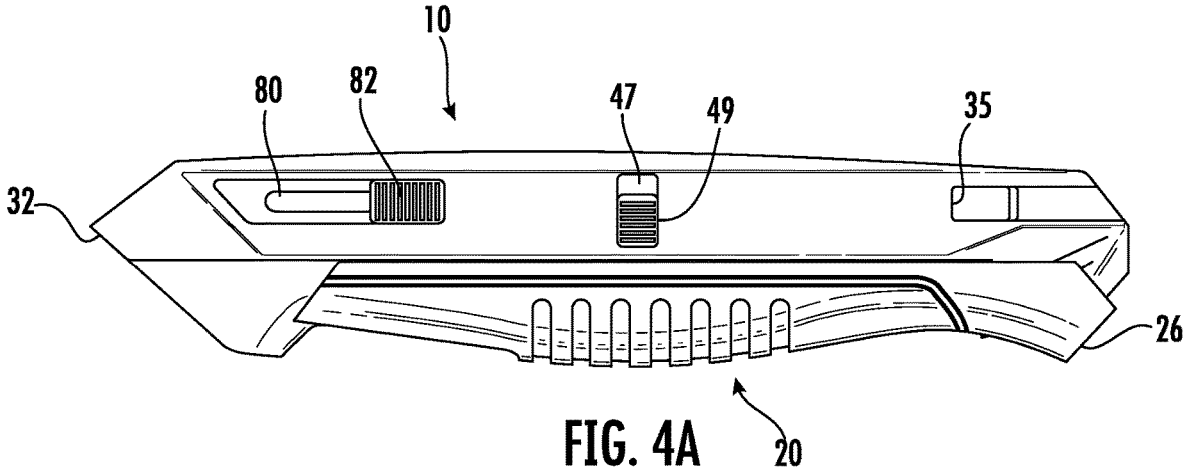
FIGS. 4A-4C are front views of the knife at the grip position of FIG. 1 with a three position blade locking configuration illustrated schematically.
Figure 4B:
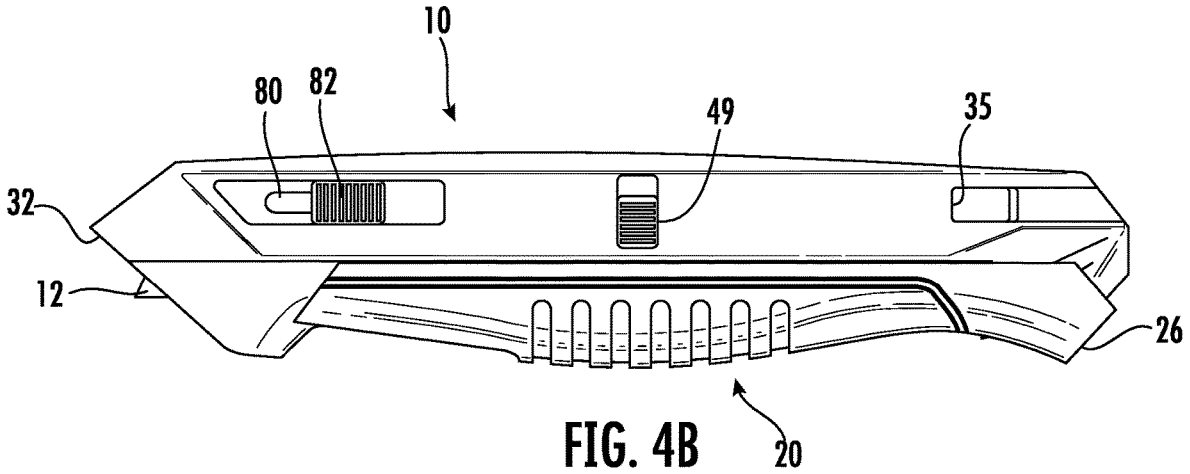
Figure 4C:
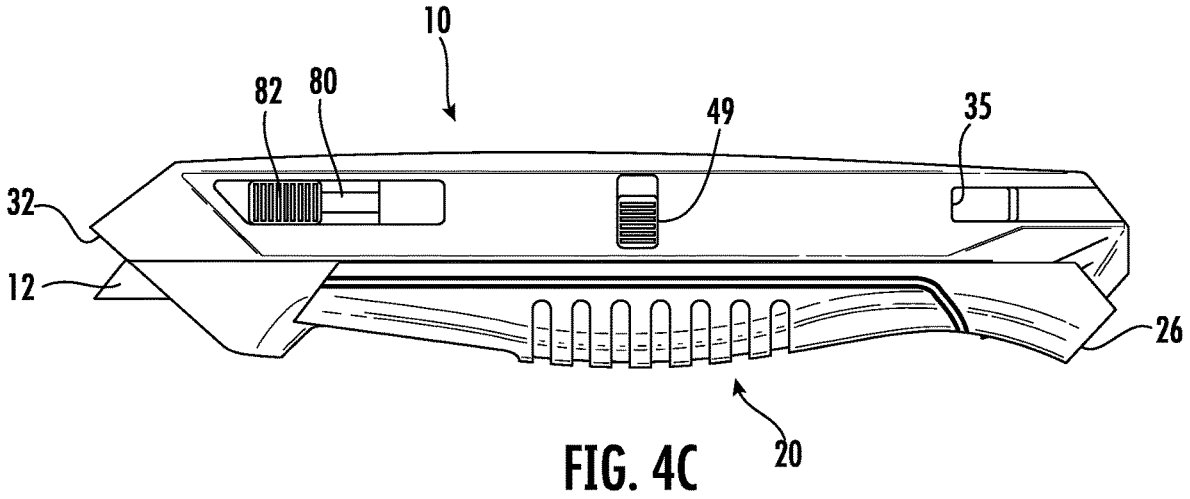

The front side of the section 40 includes a longitudinal slot 80. A position actuator 82 is received in the slot for longitudinal movement along the slot. The actuator mechanically fixedly connects with the blade slider 72/blade carrier 74. The blade carrier positions the received blade relative to the frontal blade opening 34. As best illustrated in FIGS. 4A-4C, the position actuator 82 is slidable along the slot 80 to provide various positions for the blade to selectively control its projection through the frontal opening and its retraction into the housing.

The rear of the section 40 mounts the line cutter blade 14 having a central opening. A projection 90 extends through the central opening in the blade to fixedly position the blade. The rear portion of the blade also engages a transverse shelf 92 and an inclined shoulder 94 so that the line blade is in a stable fixed position within the section.

The protective grip 20 is retained to the blade housing via the fasteners 62 which connect with the grip slide assembly. In addition, the exterior front and back of the housing sections are contoured to be complementary with the upper and opposed interior skirt portions 22 of the grip so that the grip is longitudinally slidable along the housing. When the protective grip is moved to the forward position of FIG. 1, the forward portion 24 of the grip obstructs access to the frontal opening 34 and the blade 12. The grip release tab or button 49 is then upwardly displaced and the grip may be manually moved toward the rear until the detent 68 is engaged by the lug 67 to lock the grip at the stable locked position of FIG. 2. In this position, the rear portion 26 of the grip obstructs access to the line cutter blade 14.

It will also be appreciated that the protective grip has a serrated surface 28 and is generally contoured to provide a grip surface to facilitate usage of the knife. The cutter blade may be fully retracted into the housing at the extreme position illustrated in FIG. 4A, or may be gradually projected to an intermediate position illustrated in FIG. 4B or extended to a more extended position as illustrated in FIG. 4C. In all of the latter three positions, the grip is moved to the rear to allow access to the frontal opening 34 and/or blade 12, but to obstruct access to the line cutter blade 14.

With reference to the FIGS. 20A-30, a second embodiment of a safety utility knife in accordance with the present disclosure is generally designated by the numeral 100. The safety knife functions as both a box cutter and a separate line cutter. The safety knife 100 incorporates a slidable protective grip 120 which is manually longitudinally displaceable and maintainable in two stable safety positions. In a first stable safety position illustrated in FIG. 22, the protective grip 120 is positioned at a forward position to obstruct access to a forward projecting blade 112. In a second stable safety position best illustrated in FIG. 23, the safety slide is disposed in a second rearward position restricting access to a line cutter blade 114.

Figure 21A:
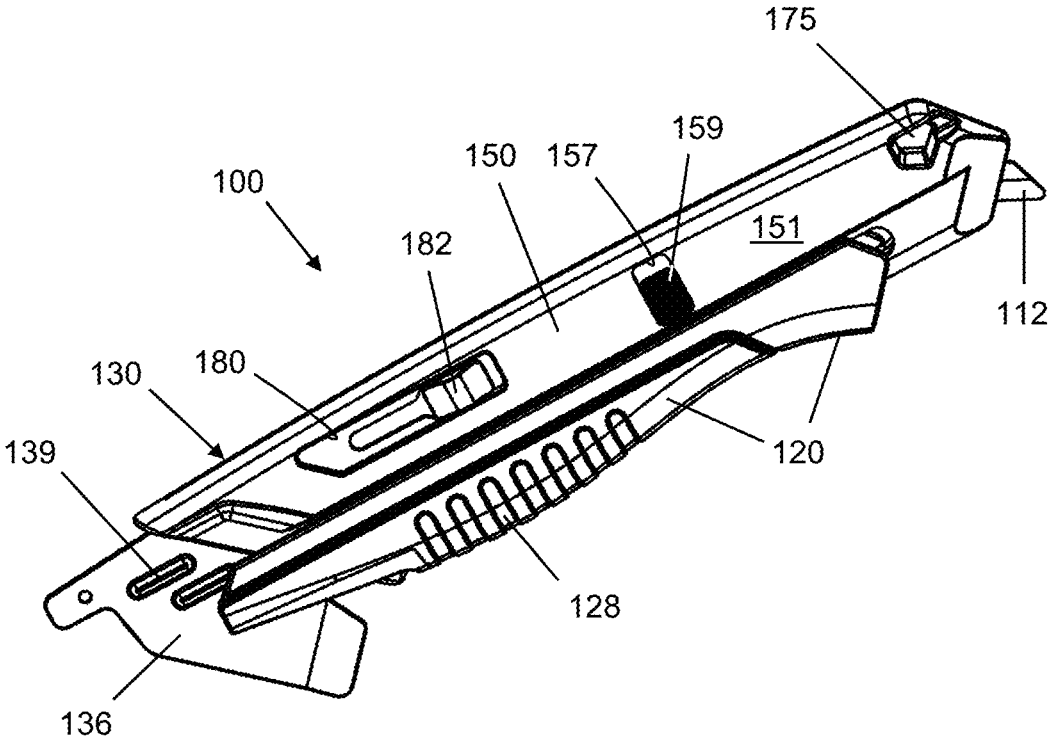
FIGS. 21A, 21B and 21C are respectively a front perspective view, a left end view and a right end view of the safety knife of FIG. 20A with the grip disposed in a second position.
Figure 21B:
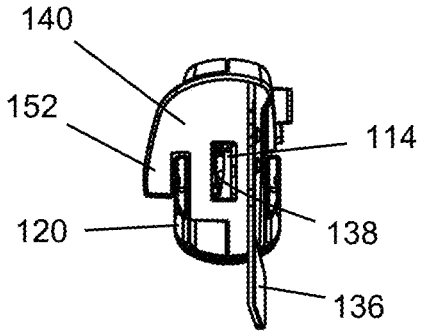
Figure 21C:
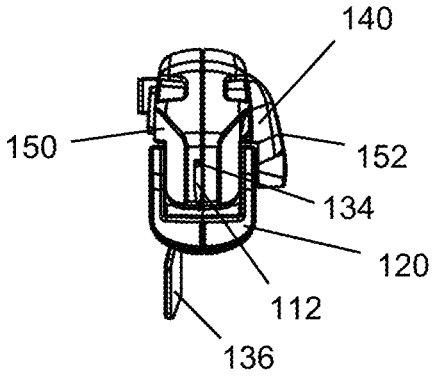
Figure 23:
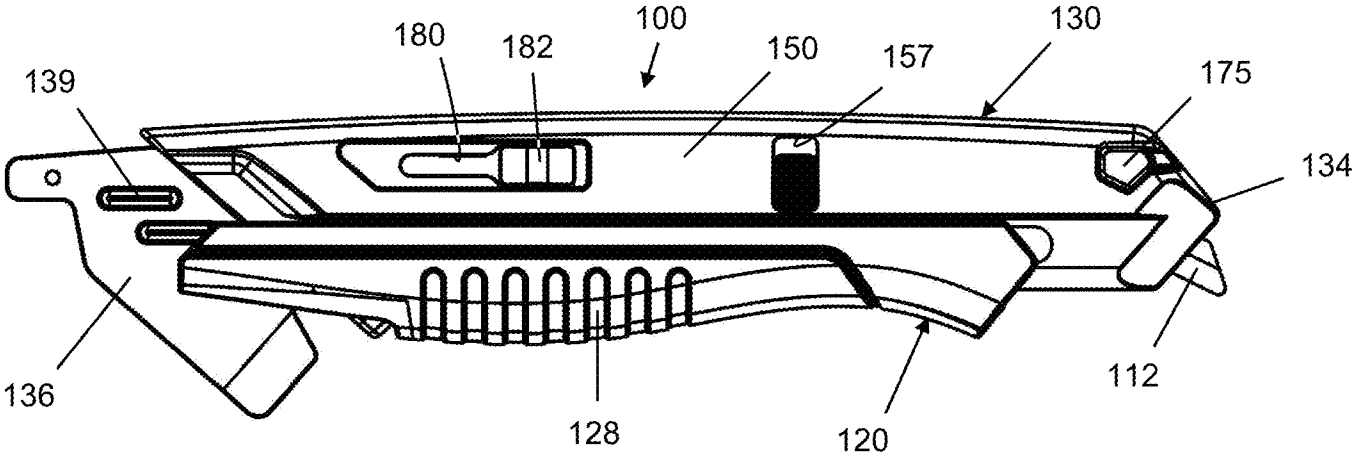
FIG. 23 is a front side view of the safety knife of FIG. 21A.
Figure 22:
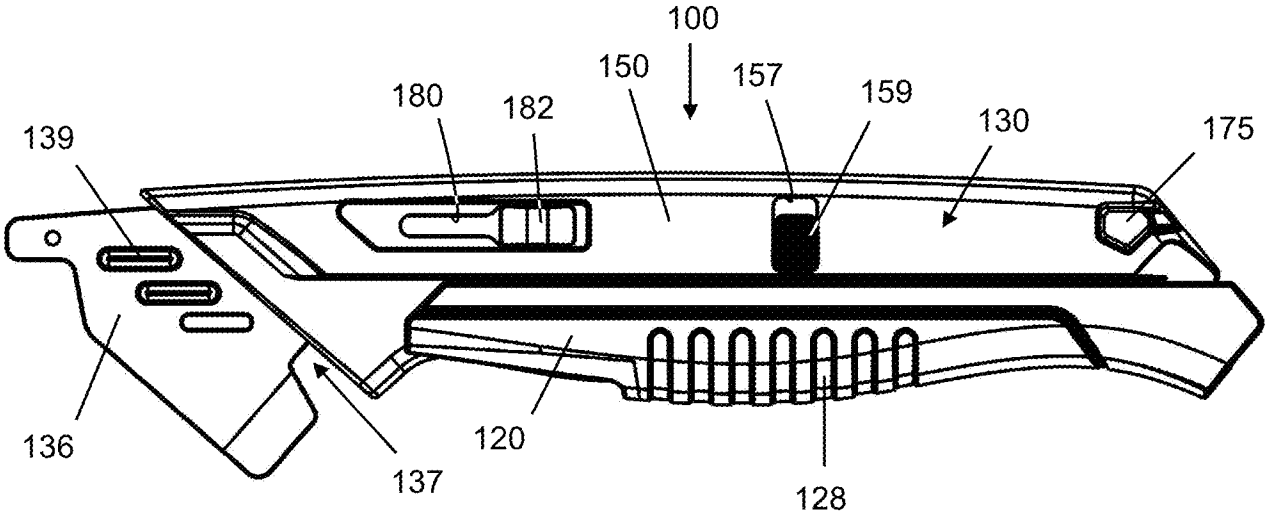
FIG. 22 is a front side view of the safety knife of FIG. 20A.
Figure 24B:
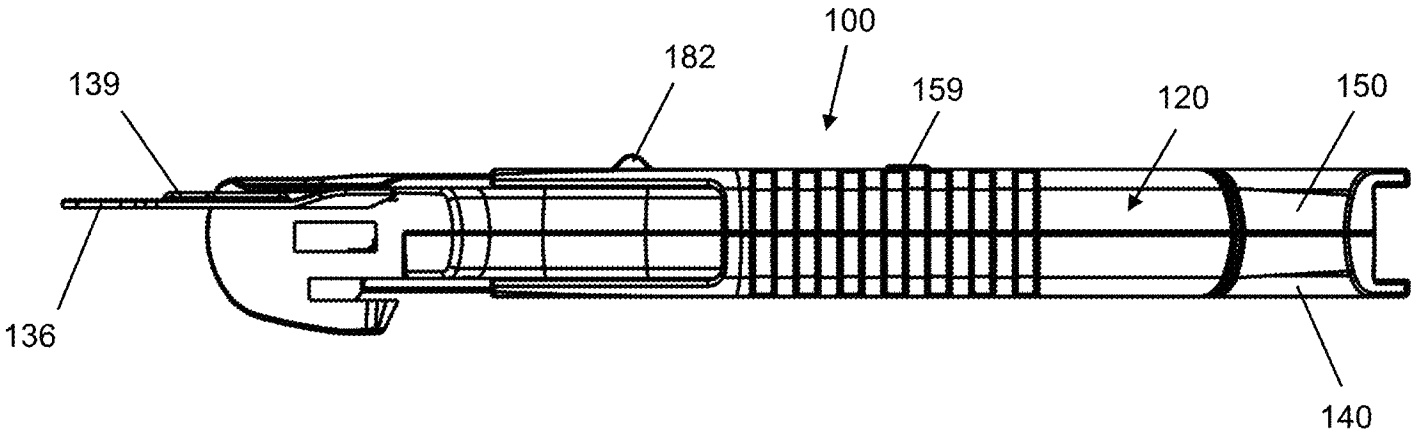
FIGS. 24A, 24B and 24C are respectively a back view, a bottom view and a top view of the safety knife of FIG. 20A.
Figure 24A:
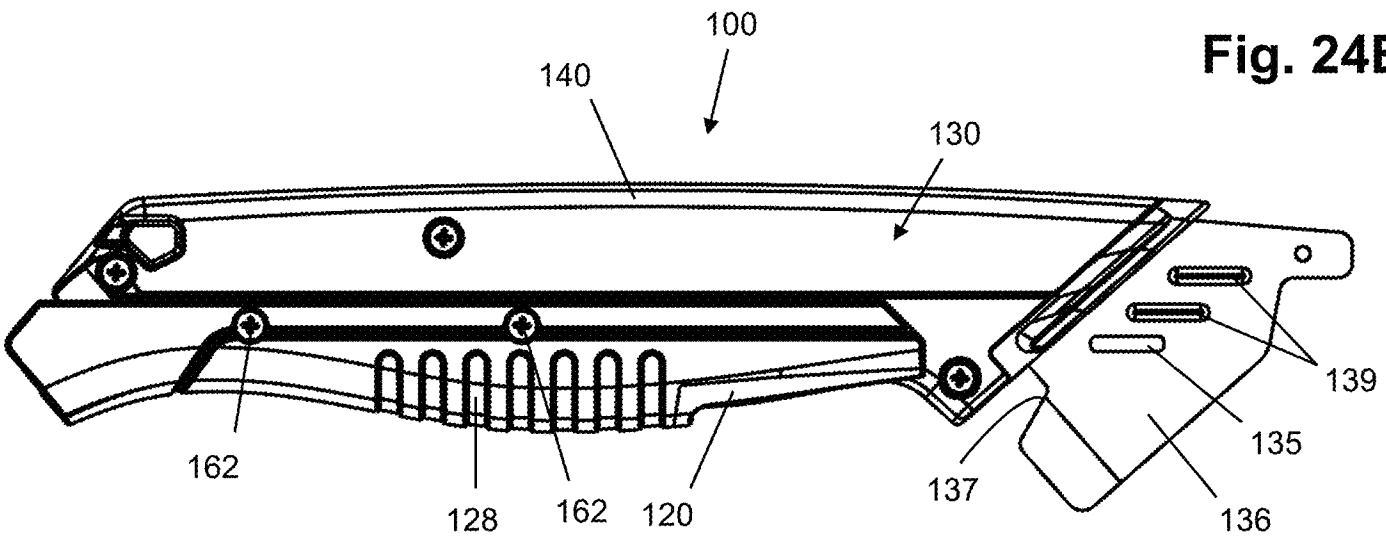
Figure 24C:
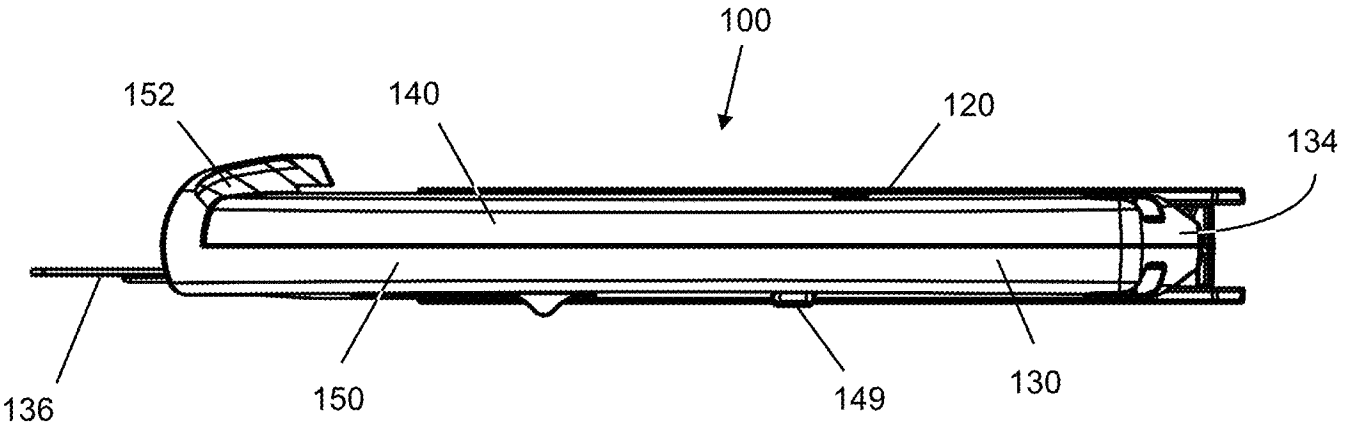
Figure 25C:
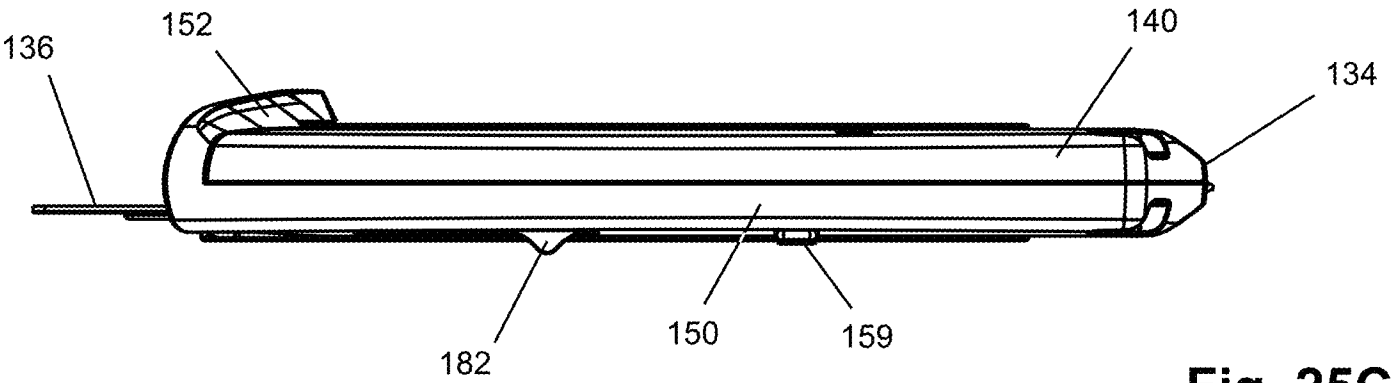
FIGS. 25A, 25B and 25C are respectively a back view, a bottom view and a top view of the safety knife of FIG. 21A.
Figure 25B:
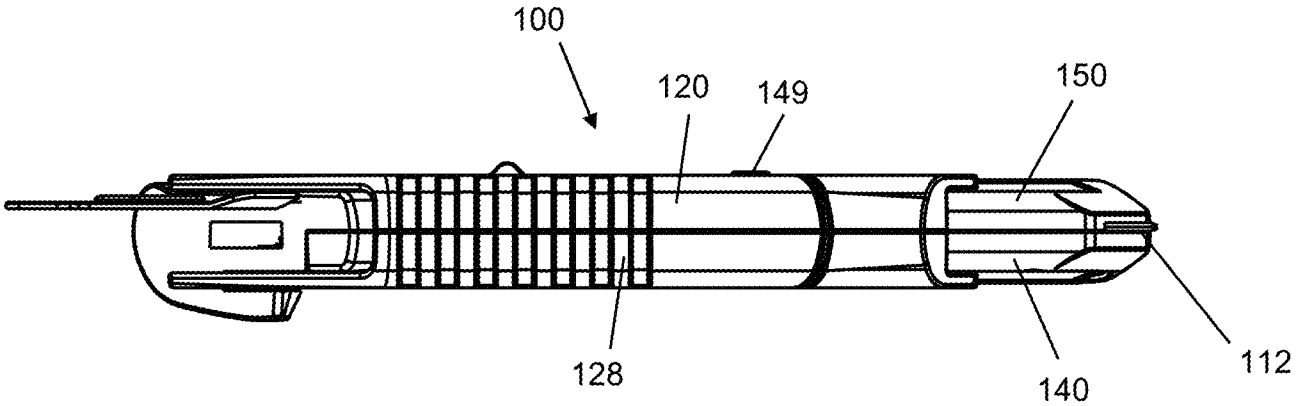
Figure 25A:
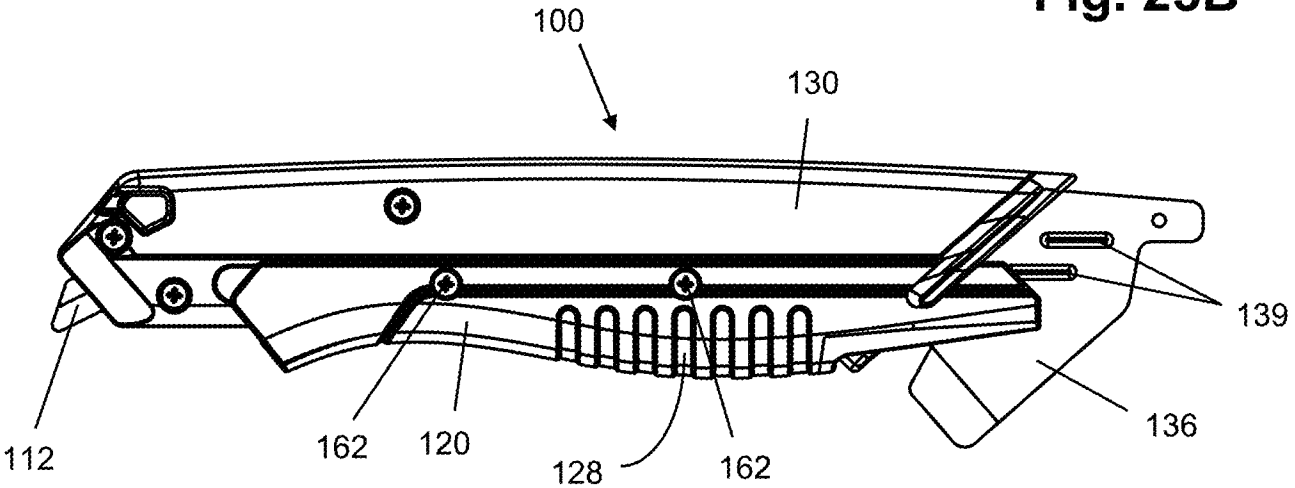

The safety knife 100 has an elongated contoured aesthetically pleasing housing 130. The protective grip 120 likewise has a coordinated contoured structure which has a soft and convenient feel for the user, as will be detailed below. The protective grip 120 has a quasi-U-shaped transverse section which encloses lower or bottom portions of the housing 130, as best shown in FIGS. 20C and 21C.

The knife has a housing 130 which is formed from a pair of elongated quasi-shell-like sections 140 and 150. the rear portion of section 150 forms a retaining arm 152 for receiving and interlocking around the rear portions of section 140 and grip 120. The sections engage along a medial interface through the top and bottom. The forward portion of the housing forms a nose-like protuberance 132. The protuberance defines a frontal blade opening 134.

A rear portion of the housing receives a sleek rear shield 136 configured to cooperatively obstruct access to a restricted blade 138 opening. The shield is preferably a stamped steel component molded in place to section 140. the shield cooperatively forms an access slot 137 leading to the restricted blade opening 138. Parallel oblong reinforcement ribs 139 integrally project from the shield 136. The shield 136 has an oblong opening 135 for receiving a lanyard (not illustrated).

Figure 27:
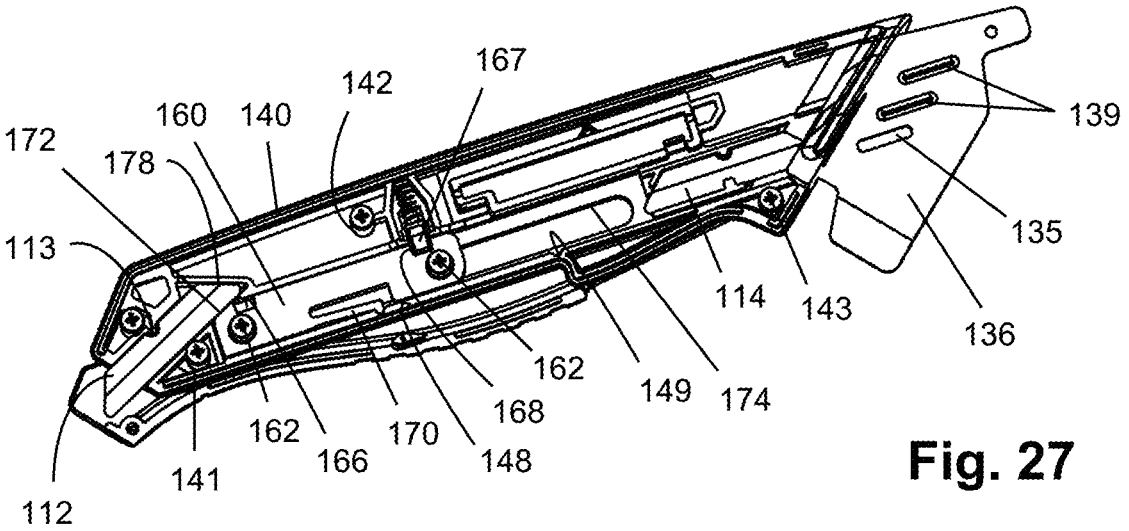
FIG. 27 is an interior view of the safety knife of FIG. 20A.

With additional reference to FIG. 26-30, section 140 interiorly mounts three spaced bosses 141, 142 and 143. The bosses receive screws 144 connecting through correspondingly located openings of the second section 150 to threadably engage the bosses to secure the sections together. The screws 144 are shown in FIG. 27 prior to final assembly.

Figure 28:
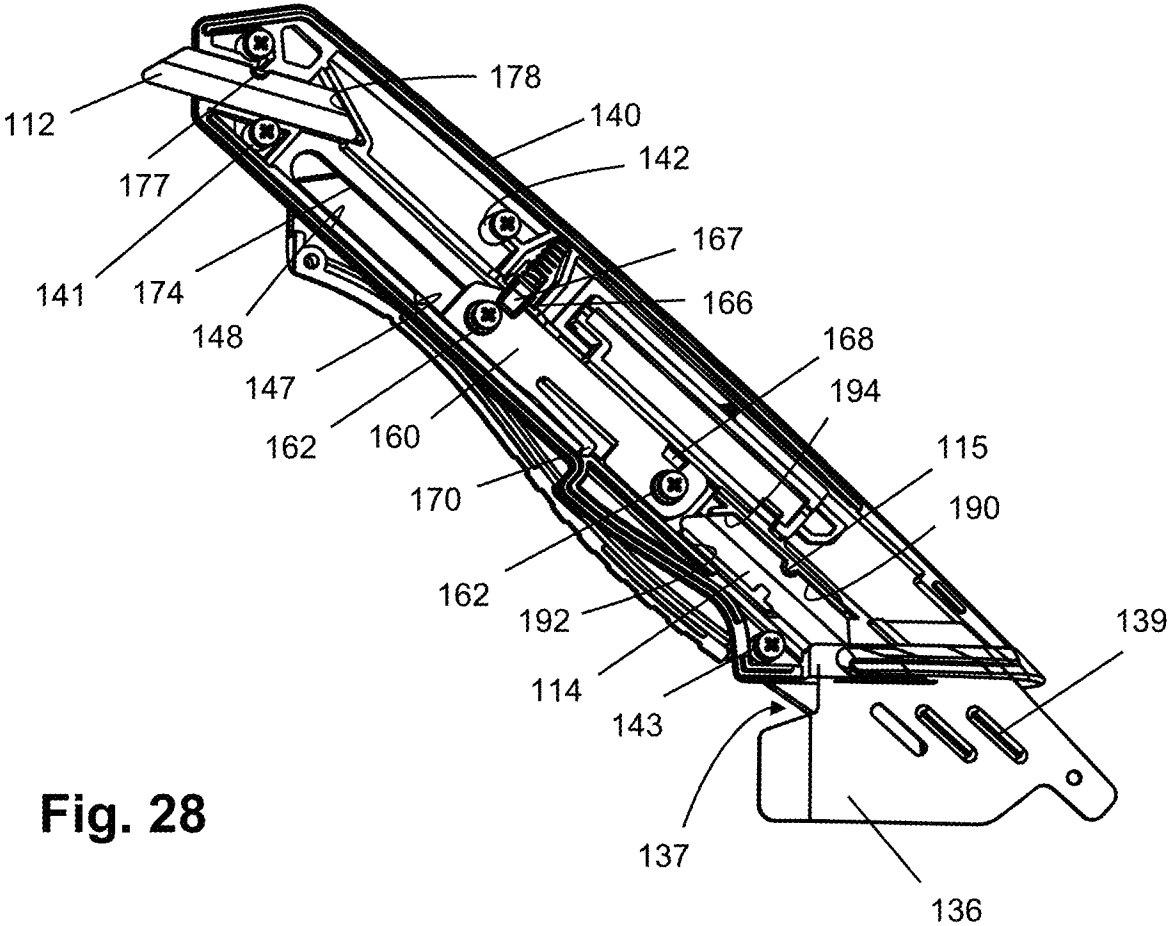
FIG. 28 is an interior view of the safety knife of FIG. 21A.
Figure 29:
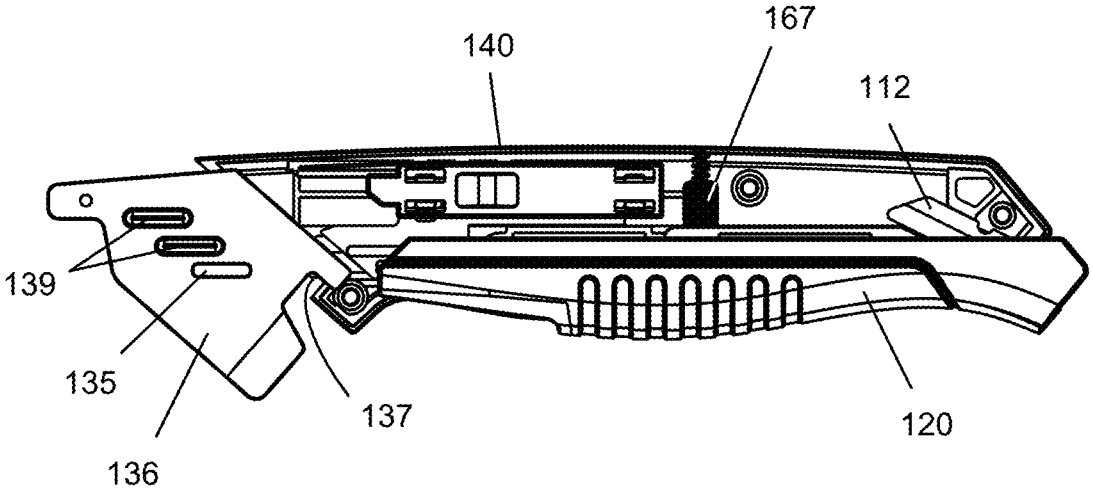
FIG. 29 is an interior view from an opposite perspective to that of the safety knife of FIG. 28 and from a different angle thereof.
Figure 30:
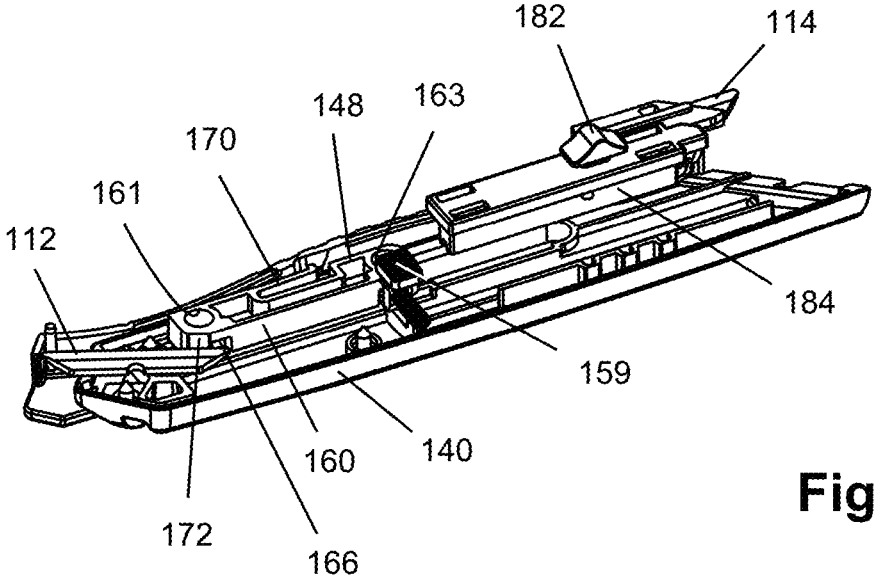
FIG. 30 is another interior view of the safety knife of FIG. 21A with the portions of the grip portion being removed.

The housing section 140 interiorly receives and mounts a grip slider 160 which slides along a channel at the interior. The section also interiorly has a longitudinal strip-like linear bearing surface 148 with spaced detents 147 and 149. the The slider 160 has an integral biased pawl 170 which slides along bearing surface 148 and is engageable in detent 147 or 149 to provide stops for the longitudinal displacement of slider 160. A forward angled edge 172 of the slider is complementary to a portion of the mounted blade 112. The slider has a pair of longitudinally spaced openings 161 and 163. The openings are alignable along a slot 154 of section 150 and slot 174 of section 140 and are also alignable with corresponding openings in the grip 120. Screws 162 are fastened through the grip openings and the slots into the openings 161 and 163 to secure the grip 120 to the slider 160. Screws 162 are illustrated in FIGS. 27 and 28 prior to final assembly.

Figure 26:
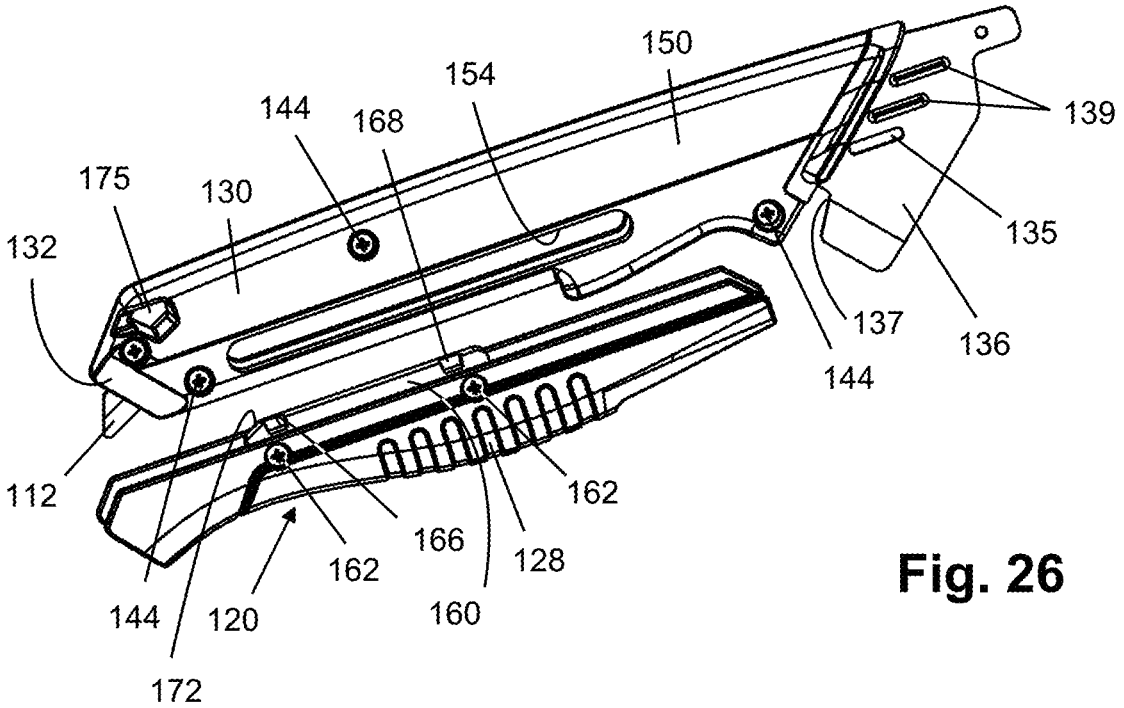
FIG. 26 is a partially disassembled view of the safety knife of FIG. 21A.

The slider 160 also includes corresponding longitudinally spaced detents 166 and 168. The detents are alignable with a spring-loaded locking lug 167. Upon selective longitudinal displacement of the grip, a detent 166 or 168 will align with the locking lug 167. The lug 167 is spring biased to engage in a selected detent to provide a stable fixed position of the slide, such as illustrated in FIG. 26 or 27. The opposed face of the section 150, which constitutes the frontal face 151 of the knife, has a recess 157 which receives a button 159. When the button 159 is pushed upwardly, the locking lug 167 disengages from the detent and the grip is free to be longitudinally manually displaced relative to the sections 140 and 150. The two detents 166 and 168, as well as detents 147 and 149, essentially define the stable protective grip positions illustrated respectively in FIGS. 22 and 23.

A trapezoidal cutting blade 112 having an upper notch 113 is fixedly mounted to a forward portion of the housing. A transverse projection 177 is complementary with the notch 113. The blade is partially received at a rear blade portion in a pocket 178, and the projection 177 locks into the notch to provide a stable blade mount. An ejector 175 is depressible to eject the box cutting blade 112.

The front side 151 of the section 150 includes a longitudinal slot or window 180. A blade position actuator 182 is received in the slot for longitudinal movement along the slot to manually extend the blade exposure of the line cutter blade 114. The actuator 182 is mounted to a platform 184 which longitudinally moves to extend the line cutter blade 114 relative to the opening 138.

The rear of the section 140 mounts the line cutter blade 114 having a medial edge notch 115. A pocket 190 captures the blade and preferably a projection extends into the notch 115 to retain the blade. The forward portion of the blade also engages a transverse shelf 192 and an inclined shoulder 194 so that the line blade is in a stable fixed position within the section but is extendable relative to the restricted rear opening 138 via the actuator 182.

The protective grip 120 is retained to the blade housing via the fasteners 162 which connect with the grip slide assembly. In addition, the exterior front and back of the housing sections are contoured to be complementary with the upper and opposed interior skirt portions 122 of the grip so that the grip is longitudinally slidable along the housing. When the grip is moved to the forward position of FIG. 22, the forward portion 124 of the grip obstructs access to the frontal opening 134 and the blade 112. The grip release button 159 is then upwardly displaced, and the grip may be manually moved toward the rear until the detent 168 is engaged by the lug 167 to lock the grip at the stable locked position of FIG. 26. In this position, the rear portion 126 of the grip obstructs access to the line cutter blade 114.

The grip 120 preferably has a rubber composition with a serrated surface 128 and is generally contoured to provide a grip surface to facilitate usage of the knife. The protective grip 120 is likewise movable to the rear to allow access to the frontal opening 134 and/or blade 112, but to obstruct access to the line cutter blade 114.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A knife comprising:

a housing having a forward portion defining a forward blade opening and a rear portion protectively leading to a rear blade opening;

a protective grip mounted to said housing and slidably displaceable therealong between a first position obstructing access to a first blade projecting from said forward blade opening and a second position obstructing access to a second blade disposed at said rear blade opening; and a slider with a pawl engageable in a first detent of the housing for securing said protective grip in a stable engagement at the first position and engageable in a second detent of the housing for securing said protective grip in a stable engagement at the second position.

2. The knife of claim 1 wherein said slider is disposed in said housing and said housing defines a longitudinal slot and said grip is secured through said slot to said slider.

3. The knife of claim 2 wherein said slider has a third detent, a fourth detent longitudinally spaced from the third detent and a spring-loaded lug in the housing is receivable in each of said third detent and said fourth detent and said housing has an exterior opening with a displaceable button which is manually moveable to withdraw the lug from each of the longitudinally spaced detents and allow said slider to slide relative to the housing.

4. The knife of claim 2 wherein said slider comprises a third detent and a fourth detent longitudinally spaced from each other, the knife further comprising a lug in the housing separately receivable in the third detent and the fourth detent to lock said slider, and withdrawable from the third detent and the fourth detent to allow sliding reciprocation of said slider.

5. The knife of claim 1 wherein said second blade is mounted for access through said rear blade opening.

6. The knife of claim 1 wherein said housing defines a longitudinal slot and an actuator is mounted in fixed relationship to a blade positioner assembly and is accessible through said slot to facilitate longitudinal displacement of said second blade relative to said housing.

7. The knife of claim 1 wherein said first blade is fixedly mounted to partially extend through the forward blade opening.

8. The knife of claim 1 wherein said grip has a rubber molded composition.

9. The knife of claim 1 wherein said grip has a quasi-U-shaped section which extends at opposed sides of said housing.

10. A knife comprising:

a housing having a forward portion defining a first blade opening and having a rear portion defining a second blade opening and mounting a first blade extending from said first blade opening and a second blade extendable relative to said second blade opening;

a grip mounted to said housing for slidable displacement therealong between a first position obstructing access to the first blade projecting from said first blade opening and a second position obstructing access to the second blade disposed adjacent said second blade opening;

a slider assembly disposed in said housing and engaged with said grip for slidable displacement therewith to secure said grip in a stable engagement at the first position or the second position; and a blade positioning assembly that is slidably manually movable to longitudinally displace said second blade relative to said housing.

11. The knife of claim 10 wherein said housing defines a longitudinal slot and said grip is connected through said slot to a slide member of said slider assembly disposed in said housing.

12. The knife of claim 10 wherein said slider assembly comprises a slide member having a pair of longitudinally spaced detents and a spring-loaded lock member is receivable in one of said longitudinally spaced detents, and said lock member connects with a displaceable button which is manually moveable to withdraw the lock member from each of said longitudinally spaced detents and allow said slide member to slide relative to the housing.

13. The knife of claim 10 wherein said second blade is mounted for access through said second blade opening.

14. The knife of claim 13 wherein said blade positioning assembly comprises a longitudinally displaceable actuator which is moveable to displace the second blade relative to said housing.

15. The knife of claim 10 wherein said grip further has a plurality of generally transversely extending serrations.

16. The knife of claim 10 wherein said grip has a rubber molded composition.

17. The knife of claim 10 wherein said grip has a quasi-U-shaped section which extends at opposed sides of said housing.

18. The knife of claim 10 wherein said housing has a metal shield at a rear portion thereof, and said shield at least partially defines an access slot leading to said second blade opening.

19. The knife of claim 10, wherein said slider assembly comprises a pawl that is slidable on a longitudinally extending bearing surface of the housing when the grip is slidably displaced between the first position and the second position.

20. The knife of claim 19, comprising a first detent for receipt of the pawl when the grip is in the first position and a second detent longitudinally spaced from the first detent for receipt of the pawl when the grip is in the second position.

* * * * *